US007472436B1

(12) United States Patent
Barrett

(10) Patent No.: US 7,472,436 B1
(45) Date of Patent: Jan. 6, 2009

(54) ANIMAL-SHAPED SLEEPING AREA FOR CHILDREN

(76) Inventor: Yusuf M. Barrett, 102 55th St. SE., Washington, DC (US) 20019

( * ) Notice: Subject to any disclaimer, the term of this patent is extended or adjusted under 35 U.S.C. 154(b) by 658 days.

(21) Appl. No.: 10/684,954

(22) Filed: Oct. 15, 2003

(51) Int. Cl.
*B63H 3/00* (2006.01)
*A47G 9/08* (2006.01)

(52) U.S. Cl. ..... 5/413 R; 5/414; 446/72

(58) Field of Classification Search ..... 5/413 R, 5/907; 446/72; 135/96
See application file for complete search history.

(56) References Cited

U.S. PATENT DOCUMENTS 3,840,919 A * 10/1974 Middleton ..... 5/413 AM
3,842,454 A * 10/1974 Young ..... 5/413 R
4,236,263 A * 12/1980 Allee ..... 5/413 R
4,316,287 A * 2/1982 Rule ..... 2/69.5
5,093,947 A * 3/1992 Henegar et al. ..... 5/482
5,345,961 A * 9/1994 Yercha et al. ..... 135/87
5,933,886 A * 8/1999 Washington ..... 5/494
5,941,264 A * 8/1999 Gregg ..... 135/116
6,371,144 B1 * 4/2002 Ragatz ..... 135/156
6,722,084 B2 * 4/2004 Berman ..... 52/2.11
6,752,164 B1 * 6/2004 Park ..... 135/136

OTHER PUBLICATIONS

St. Petersburg Times article by Jeff Klinkenberg, published Nov. 10, 2003, entitled "Real Florida: Monster garage".*

* cited by examiner

*Primary Examiner*—Michael Trettel
(74) *Attorney, Agent, or Firm*—Richard L. Huff

(57) ABSTRACT

A hollow animal-shaped structure having an entrance into which a child may crawl to take a nap. The structure may have a swinging door at the entrance, which is located at the mouth or chest of the animal. The structure may have a padded floor for the safety and comfort of the child. The structure may be equipped with an independent source of electrical current to enable its eyes to light up and to enable the animal to play back a recorded sound of that animal.

6 Claims, 3 Drawing Sheets

ANIMAL-SHAPED SLEEPING AREA FOR CHILDREN

CROSS-REFERENCE TO RELATED APPLICATIONS

STATEMENT REGARDING FEDERALLY SPONSORED RESEARCH OR DEVELOPMENT (Not applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION

1) Field of the Invention

The field of this invention is structural sleeping areas for children. More precisely, it is structures shaped like animals for children to use while taking naps.

2) Description of the Related Art

Little children need naps during the day. Little children also like familiar things that are special to them. In the prior art, the child usually took a nap in his or her crib. A crib is inaccessible to the child who wishes to lie down immediately. Napping on a chair or sofa presents the potential hazard of the child turning over during sleep and falling off the piece of furniture. Napping on a traveled floor or carpet is unsanitary. What has been lacking from the prior art is a clean place that the child can access on his or her own and that presents no potential danger allowing falls.

BRIEF SUMMARY OF THE INVENTION

The structure of the present invention addresses the above problems. These structures allow the child to take a nap in a familiar personal place which is clean, soft and presents no danger of falling. The structure of the present invention allows for napping without being lifted by a parent. The structures of the present invention are hollow, animal-shaped structures. The materials from which the structures of one embodiment are made are soft materials, such as cotton or wool. The structures of a second embodiment are made of inflatable material such as rubber or air-tight fabric. The structures are shaped like animals and have openings in the mouth or chest area so that children may crawl inside to lie down and nap. There may be a swinging door so that the opening may be closed and give the appearance of a complete animal.

DETAILED DESCRIPTION OF THE INVENTION

Figure 1:
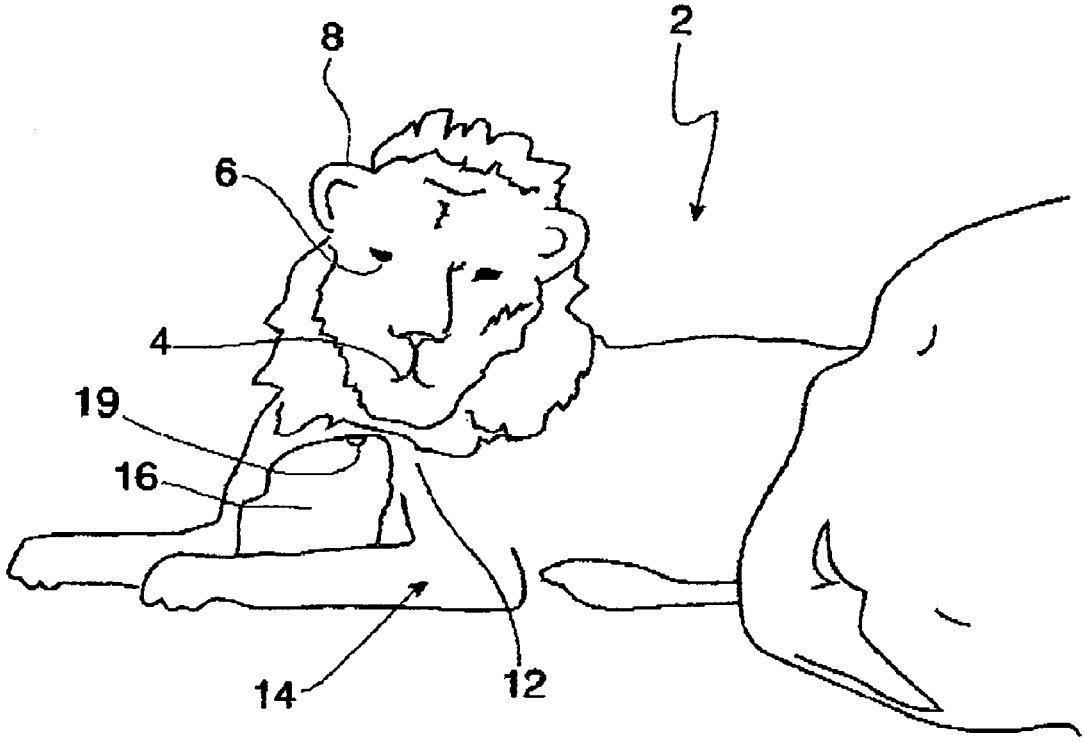
FIG. 1 is an elevational perspective view of the structure of one embodiment of this invention.
Figure 2:
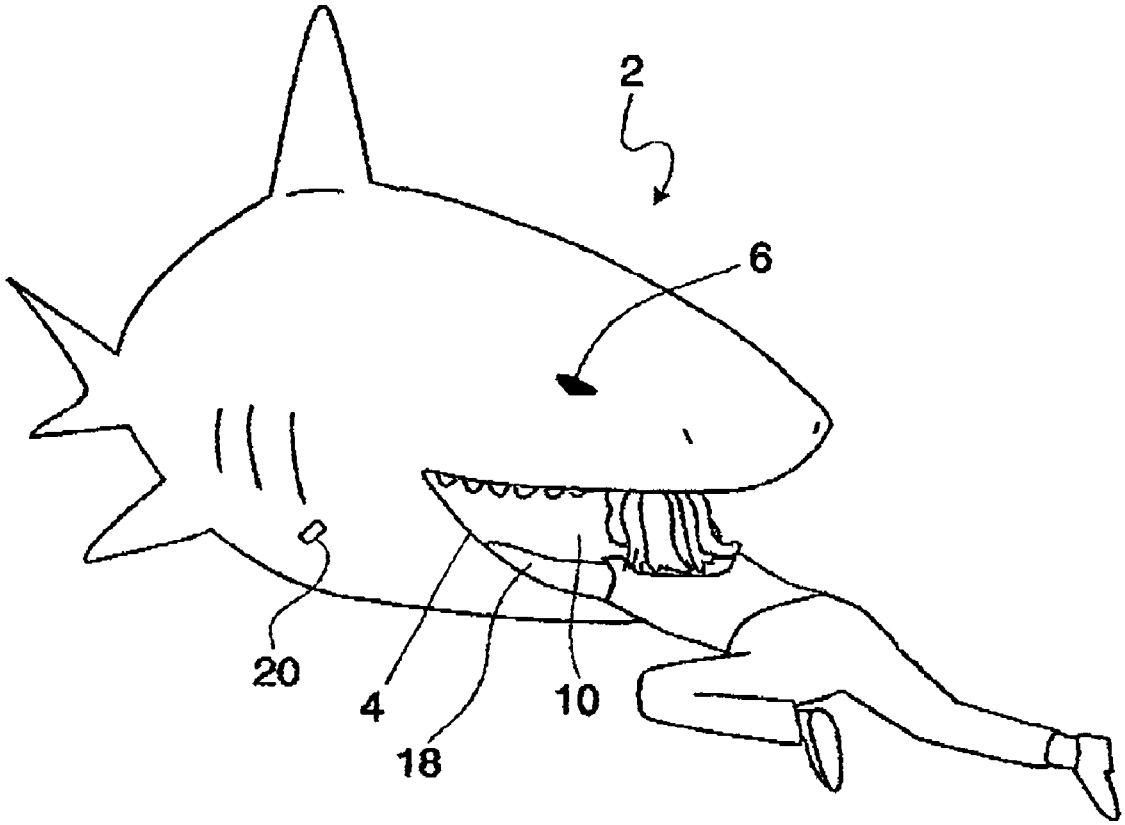
FIG. 2 is an elevational perspective view of the structure of a second embodiment of the present invention.
Figure 3:
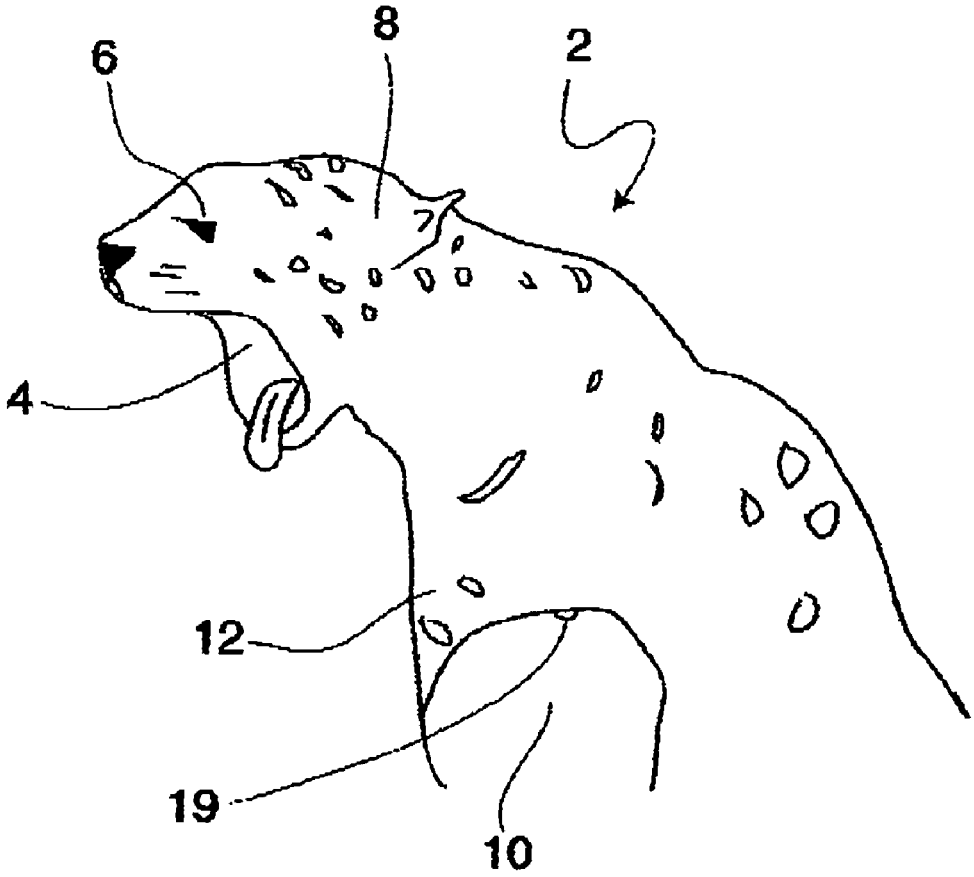
FIG. 3 is an elevational perspective view of the structure of a third embodiment of the invention.

The invention will now be described with reference to the above drawings, wherein like numerals refer to like features throughout.

The structure 2 of the present invention is shaped like an animal and contains all the features of a real animal which are familiar to a child, such as mouth 4, eyes 6, ears 8, etc. The animal is hollow, there being sufficient space in the hollow area to allow the child to at least partially fit while taking a nap. The entrance 10 to the inside of the animal is through the mouth 4 if the animal is completely prone or through the chest 12 if the animal is supported by its front legs 14.

There may be a swinging door 16 which is easily swung inwardly so that the child can enter. When in the closed position, the swinging door 16 gives the impression that the animal is complete. There may also be a floor 18 for the comfort and safety of the child.

There may be an independent source of electric current (not shown), such as batteries, in the structure. The electric current enables the eyes 6 of the animal to light up, a small, dim light 19 to shine inside the animal, and, where appropriate, the recorded sound of the animal to be given whenever the child passes through the entrance 10.

In one embodiment, the structure 2 is permanent. It is made of soft fabric material such as cotton or wool and is stuffed with a soft material which will allow for sturdy support. One example of the stuffing is cotton. In this embodiment, the swinging door 16 is a padded panel having light weight. The floor 18 may be a padded cloth panel.

In another embodiment, the structure 2 may be inflated or deflated in order to save space when it is not in use. This may be done by simply attaching an air pump to an air valve 20 located on the animal and operating the pump. In this embodiment, the swinging door 16 is an inflated panel. The floor 18 in this embodiment may be an inflated panel.

In the use of this structure, the sleepy child crawls into his or her private napping area and takes a nap. If a swinging door 16 is present, it gently rests on the child. It is not necessary for the child to be on a separate story of the building away from the parent. There is no danger of falling from a piece of furniture that does not have side supports.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A hollow, three-dimensional, free-standing animal-shaped structure for providing a place for a child to take a nap, said structure being of such a size as to allow a child to fit at least partially inside, said structure having features of a real animal, said structure being made of padded fabric, and said structure having an entrance for the child, said entrance having a swinging door, and said entrance being of such a size as to allow the child to crawl into the structure without changing the size of the entrance.

2. The structure of claim 1, wherein the animal has a mouth and the entrance for the child is located at the mouth of the animal.

3. The structure of claim 1, wherein the animal has a chest and the entrance for the child is located at the chest of the animal.

4. The structure of claim 1, wherein the structure has a floor.

5. The structure of claim 1, wherein the animal has eyes that light up.

6. The structure of claim 1, wherein a dim light is located inside the animal.

* * * * *